US008876260B2

(12) United States Patent
Yamada

(10) Patent No.: US 8,876,260 B2
(45) Date of Patent: Nov. 4, 2014

(54) LIQUID EJECTION HEAD

(71) Applicant: Canon Kabushiki Kaisha, Tokyo (JP)

(72) Inventor: Kazuhiro Yamada, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/949,017

(22) Filed: Jul. 23, 2013

(65) Prior Publication Data

US 2014/0028758 A1 Jan. 30, 2014

(30) Foreign Application Priority Data

Jul. 25, 2012 (JP) ..... 2012-164686

(51) Int. Cl.
*B41J 2/045* (2006.01)
*B41J 2/155* (2006.01)
*B41J 2/14* (2006.01)

(52) U.S. Cl.
CPC .... *B41J 2/14088* (2013.01); *B41J 2002/14459* (2013.01); *B41J 2/1404* (2013.01); *B41J 2/155* (2013.01); *B41J 2/1408* (2013.01)
USPC ..... 347/68

(58) Field of Classification Search
None
See application file for complete search history.

(56) References Cited

FOREIGN PATENT DOCUMENTS

| | | | |
|---|---|---|---|
| JP | 2007-8123 A | | 1/2007 |
| JP | 2007008123 A | * | 1/2007 |
| JP | 2009-149057 A | | 7/2009 |

* cited by examiner

*Primary Examiner* — Matthew Luu
*Assistant Examiner* — Erica Lin
(74) *Attorney, Agent, or Firm* — Canon USA Inc IP Division

(57) ABSTRACT

A liquid ejection head includes a plurality of recording element substrates that each include an energy generating element generating energy utilized for ejecting a liquid and that each have a supply port through which the liquid is supplied to the energy generating element, a plurality of support members that each have a flow passage communicating with a corresponding one of the supply ports and that each support a corresponding one of the plurality of recording element substrates, a base substrate that supports the plurality of support members, and a heat insulating member disposed between the flow passages and the base substrate. In the liquid ejection head, a thermal conductivity of the support members is equal to or greater than a thermal conductivity of the recording element substrates, and a thermal conductivity of the heat insulating member is less than a thermal conductivity of the base substrate.

10 Claims, 9 Drawing Sheets

LIQUID EJECTION HEAD

BACKGROUND OF THE INVENTION

1. Field of the Invention

The present disclosure relates to liquid ejection heads that eject a liquid such as ink.

2. Description of the Related Art

As examples of ink ejection methods, a thermal method and a piezoelectric method are known.

A thermal method recording head includes a recording element substrate that has liquid chambers and heating elements. Nozzles through which ink is ejected are formed in the liquid chambers. The heating elements serve as energy generating elements. Application of heat by the heating elements to the ink supplied into the liquid chambers causes the ink to boil. Forces caused by bubble generation due to the boiling cause the ink to be ejected through the nozzles.

A piezoelectric method recording head includes a recording element substrate that has liquid chambers and piezoelectric elements. Nozzles through which ink is ejected are formed in the liquid chambers. The piezoelectric elements serve as energy generating elements. The piezoelectric elements are deformed when electrical energy is applied thereto. Due to deformation of the piezoelectric elements, ejection energy is applied to the ink supplied into the liquid chambers, thereby ejecting the ink through the nozzles.

Furthermore, nowadays a recording head is proposed that has a larger width than the width of a recording medium and that includes a plurality of energy generating elements arranged in the width direction of the recording medium (hereafter, simply referred to as "width direction"). Such a recording head is also referred to as a line-type head. With a recording apparatus equipped with a line-type head, an image can be recorded on a recording medium while conveying the recording medium in a direction that intersects the width direction (hereafter, referred to as "conveying direction") without performing a scan with the line-type head in the width direction. This allows printing to be performed at a comparatively high speed.

In the case where a belt-shaped image that extends in the conveying direction is recorded on a recording medium by using the line-type head, out of the plurality of energy generating elements arranged in the width direction, some of the energy generating elements are continuously operated. When some of the plurality of energy generating elements are operated, the temperature is increased in portions of the recording element substrates, the portions being located near the continuously operated energy generating elements (hereafter, these portions are referred to as "continuous operation portions").

For example, in a line-type head, to which the thermal method is adopted as the ejection method, part of heat generated due to the operation of the heating elements is transferred to the recording element substrate. As a result, the temperature is increased in portions near the continuously operated heating elements of the recording element substrate. In a line-type head, to which the piezoelectric method is adopted as the ejection method, part of electrical energy applied to the piezoelectric elements is converted into heat energy. As a result, the temperature is increased in portions of the recording element substrate, the portions being located near the piezoelectric elements, to which electrical energy is continuously applied.

In the recording element substrate, the temperature does not increase in portions near the energy generating elements that are not continuously operated (hereafter, referred to as "non-continuous operation portions"). Furthermore, a plurality of nozzles and a plurality of liquid chambers are formed in the recording element substrate. Thus, heat is not comparatively easily transferred within the recording element substrate. For this reason, heat is not easily transferred from the continuous operation portions to the non-continuous operation portions, and accordingly, the temperature distribution over the recording element substrate becomes non-uniform. Thus, the following problem tends to occur.

That is, ink supplied to the continuous operation portions of the recording element substrate is subjected to heat applied from the continuous operation portions, thereby the temperature of the ink is increased. Accordingly, the viscosity of the ink is increased. In contrast, the temperature of the ink supplied to the non-continuous operation portions of the recording element substrate is not increased, and accordingly, the viscosity of the ink is not increased.

It is known that the viscosity of the ink affects the amount of ink to be ejected, thereby affecting the print density of an image to be recorded. When the difference in temperature between the continuous operation portions and the non-continuous operation portions is large, the ink ejection amount from the continuous operation portions becomes different from that from the non-continuous operation portions, and accordingly, causing the ink ejection amount to vary in the width direction. This causes uneven print density in the recorded image, and accordingly, the quality of the image is degraded.

In particular, nowadays the demand for high-quality image for commercial use has been increasing in addition to the demand for high-speed printing performance with line-type heads. Accordingly, recording heads that reduce non-uniform temperature distributions over recording element substrates have been proposed (for example, Japanese Patent Laid-Open No. 2007-8123).

A recording element substrate of a recording head disclosed in Japanese Patent Laid-Open No. 2007-8123 has temperature adjustment flow passages through which a temperature adjustment solvent flows. The temperature adjustment flow passages extend in a direction in which a plurality of energy generating elements are arranged. In the recording head, by the solvent that flows through the temperature adjustment flow passages of the recording element substrate, continuous operation portions of the recording element substrate are cooled and non-continuous operation portions of the recording element substrate are heated. As a result, non-uniformity of the temperature distribution over the recording element substrate is reduced.

However, with the recording head disclosed in Japanese Patent Laid-Open No. 2007-8123, a pump that causes the solvent to flow and a solvent temperature controller that controls the temperature of the solvent are needed. Furthermore, power to operate the pump and the solvent temperature controller is also needed.

Japanese Patent Laid-Open No. 2009-149057 discloses a recording head that reduces non-uniformity of the temperature distribution over a recording element substrate without using a pump or a solvent temperature controller. The recording head disclosed in Japanese Patent Laid-Open No. 2009-149057 includes a support substrate serving as a support member that supports, out of surfaces of the recording element substrate, a surface in a nozzle array direction in which a plurality of nozzles are arranged. An ink flow passages, which communicate with liquid chambers of the recording element substrate, penetrate through the support substrate.

The support substrate does not have holes or grooves other than the ink flow passages, which communicate with the liquid chambers of the recording element substrate. Thus, heat is comparatively easily transferred within each support substrate. That is, the support substrate has the function of equalizing the temperature distribution with respect to the nozzle array direction over the recording element substrate. More specifically, heat of the continuous operation portions of the recording element substrate is transferred to the non-continuous operation portions of the recording element substrate through the support substrate. This suppresses an increase in temperature in the continuous operation portions and facilitates an increase in temperature in the non-continuous operation portions, thereby reducing non-uniformity of the temperature distribution over the recording element substrate.

However, in the recording head disclosed in Japanese Patent Laid-Open No. 2009-149057, heat of the support substrate may be transferred to the ink that flows through the ink flow passages of the support substrate. When heat is transferred from the support substrate to the ink, the heat of the continuous operation portions of the recording element substrate is not sufficiently transferred to the non-continuous operation portions of the recording element substrate through the support substrate. As a result, the temperature is not sufficiently increased in the non-continuous operation portions. This increases non-uniformity of the temperature distribution over the recording element substrate, and accordingly, degrades the quality of an image to be recorded.

SUMMARY OF THE INVENTION

A liquid ejection head includes a plurality of recording element substrates that each include an energy generating element generating energy utilized for ejecting a liquid and that each have a supply port through which the liquid is supplied to the energy generating element, a plurality of support members that each have a flow passage communicating with a corresponding one of the supply ports and that each support a corresponding one of the plurality of recording element substrates, a base substrate that supports the plurality of support members, and a heat insulating member disposed between the flow passages and the base substrate.

In the liquid ejection head, a thermal conductivity of the support members is equal to or greater than a thermal conductivity of the recording element substrates, and a thermal conductivity of the heat insulating member is less than a thermal conductivity of the base substrate.

Further features of the present invention will become apparent from the following description of exemplary embodiments with reference to the attached drawings.

DESCRIPTION OF THE EMBODIMENTS

Examples of an embodiment will be described below with reference to the drawings. It should be understood that the scope of the present invention is defined by the scope of the claims and not limited by the following description.

For example, shapes, arrangements, and the like described in the following do not limit the scope of the present invention. Likewise, although a thermal method is adopted in the present embodiment, the present invention is applicable to a recording head to which a piezoelectric method is adopted.

Although the present embodiment uses a line-type head, the present invention is also applicable to a serial-type liquid ejection head. For example, in the case where a serial-type liquid ejection head is used, in order to make a reduced scale copy, only part of a recording element substrate is continuously operated. In such a case, the present embodiment is useful for obtained a uniform temperature distribution over the recording element substrate.

Description of Liquid Ejection Head Structure

Figure 1:
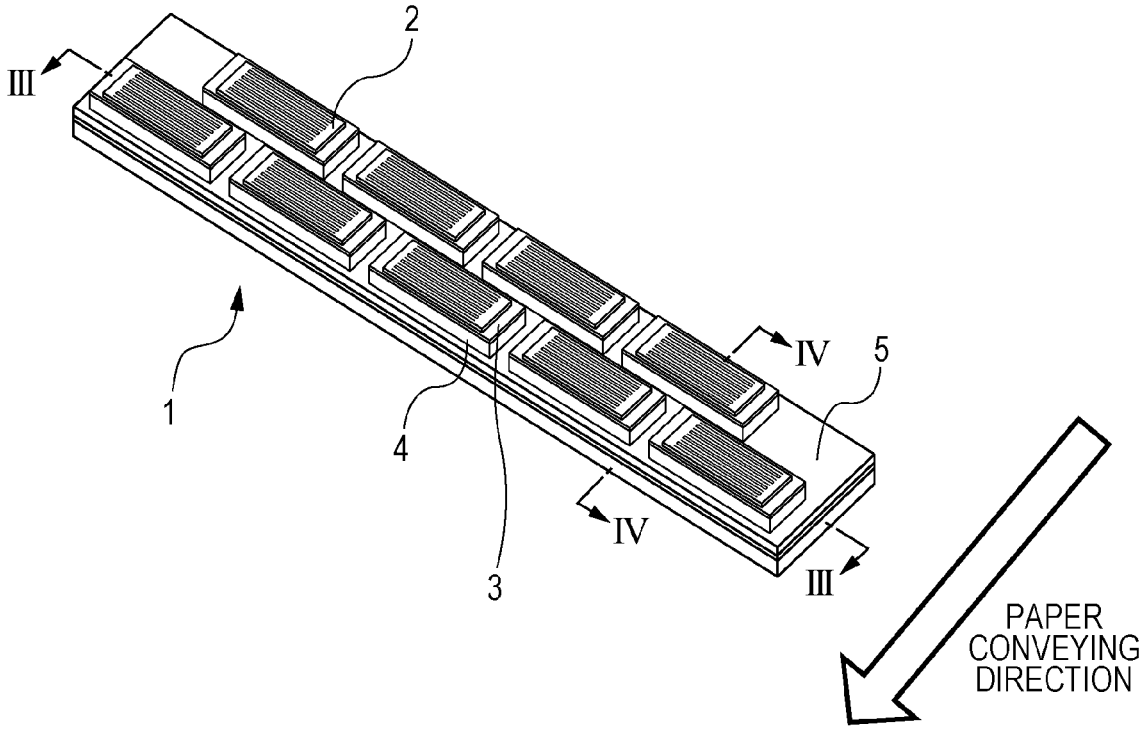
FIG. 1 is a perspective view of a liquid ejection head according to an embodiment.
Figure 2:
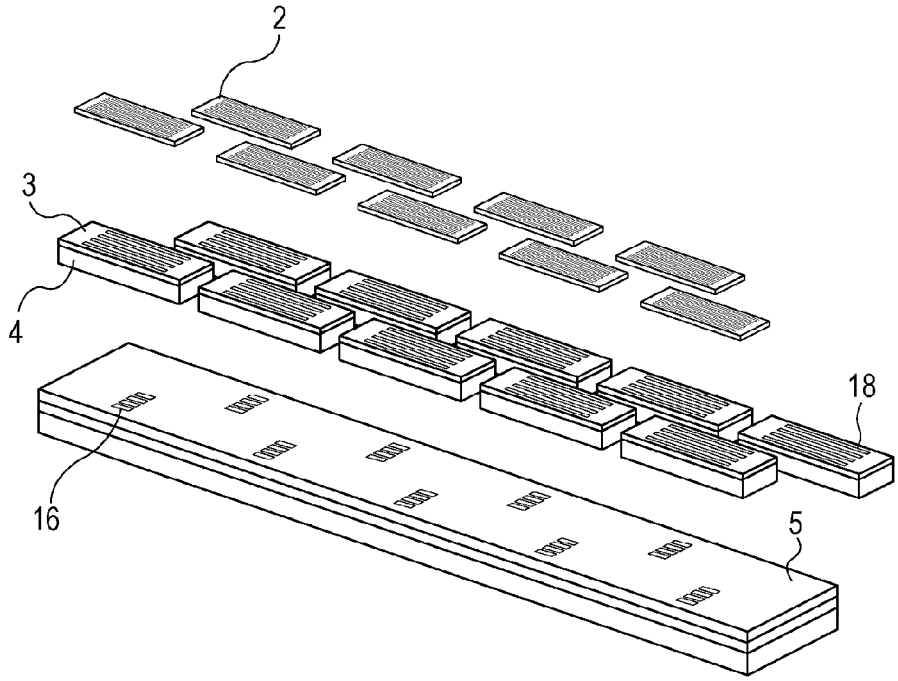
FIG. 2 is an exploded perspective view of the liquid ejection head illustrated in FIG. 1.

The structure of a liquid ejection head according to an embodiment is initially described. FIG. 1 is a perspective view of a liquid ejection head that ejects a liquid such as ink according to the present embodiment. FIG. 2 is an exploded perspective view of the liquid ejection head illustrated in FIG. 1.

As illustrated in FIGS. 1 and 2, a recording head 1 according to the present embodiment includes a plurality of recording element substrates 2, temperature equalizing members 3, heat insulating members 4, and a base substrate 5. The temperature equalizing members 3 serve as support members that each support a corresponding one of the recording element substrates 2. The heat insulating members 4 support the temperature equalizing members 3. The base substrate 5 supports the heat insulating members 4. The base substrate 5 extends in a direction that intersects a paper conveying direction (a direction indicated by the hollow arrow in FIG. 1) The plurality of recording element substrates 2 are arranged in staggered rows, the rows extending in the long-side direction of the base substrate 5. That is, the recording element substrates 2 are alternately positioned on one side and the other side in the short-side direction (paper conveying direction) of the base substrate 5.

As can be understood in the above description, the recording head 1 according to the present embodiment is a line-type head. The plurality of recording element substrates 2 are not necessarily staggered. For example, the plurality of recording element substrates 2 may alternatively be linearly arranged in the long-side direction of the base substrate 5 or in a direction inclined relative to the long-side direction of the base substrate 5 by a certain angle.

The temperature equalizing members 3 equally or more easily transfer heat compared to the recording element substrates 2. A uniform temperature distribution over each of the recording element substrates 2 is obtained by transferring heat from portions of the recording element substrate 2 to other portions of the recording element substrate 2 where the temperature is lower than the portions of the recording element substrate 2.

The temperature equalizing members 3 can be formed of a material having a high thermal conductivity and a corrosion resistance against ink. Specifically, Si, SiC, graphite, or the like can be used. Among SiCs, although a multicrystal ceramic (160 to 200 W/m/K) may be used, a single crystal wafer (300 to 490 W/m/K) having a thermal conductivity about two times higher than that of a multicrystal ceramic is more desirably used.

Although each recording element substrate 2 and a corresponding one of the temperature equalizing members 3 may be bonded to each other with an adhesive or the like, in the case where Si is selected as materials of both the recording element substrates 2 and the temperature equalizing members 3, the recording element substrate 2 and the temperature equalizing member 3 are bonded to each other more desirably by Si—Si bond. When the recording element substrate 2 and the temperature equalizing member 3 are bonded to each other by Si—Si bond, a thermal contact resistance between the recording element substrate 2 and the temperature equalizing member 3 is lower than that in the case of bonding with an adhesive, and accordingly, an improved temperature equalizing effect can be obtained.

The heat insulating members 4 have a lower thermal conductivity than that of the base substrate 5. By supporting the temperature equalizing members 3 with the heat insulating members 4, heat is not easily transferred from each recording element substrate 2 to the base substrate 5. That is, heat transferred from portions of the recording element substrate 2 to the temperature equalizing member 3 is not transferred to the base substrate 5 but is transferred to the other portions of the recording element substrate 2. Thus, a capacity of the temperature equalizing member 3 to equalize the temperature of the recording element substrate 2 is further improved.

The heat insulating members 4 can be formed of a material having a lower thermal conductivity than that of the base substrate 5. Also, the differences in linear expansion coefficient between the material of the heat insulating member 4 and the temperature equalizing member 3 and between the material of the heat insulating member 4 and the recording element substrate 2 can be comparatively small. The reason for this is as follows.

That is, the recording element substrates 2 generate heat while being operated. The temperature equalizing members 3 and the heat insulating members 4 are expanded when the heat from the recording element substrates 2 is transferred thereto. Joining portions where heat insulating members 4 and the temperature equalizing members 3 are joined to one another may be damaged when the difference in linear expansion coefficient between the heat insulating member 4 and the temperature equalizing member 3 or between the heat insulating member 4 and the recording element substrate 2 is large.

In particular in the present embodiment, as will be described later, ink flow passages are formed in the joining portions where the heat insulating members 4 and the temperature equalizing members 3 are joined to one another. Thus, damage to the joining portions may cause leakage of ink.

When the heat insulating members 4 are formed of a material, and the differences in linear expansion coefficient between the material and the temperature equalizing member 3 and between the material and the recording element substrate 2 are comparatively small, the joining portions where the heat insulating members 4 and the temperature equalizing members 3 are joined to one another are not easily damaged, and accordingly, leakage of ink is prevented.

Specifically, materials of the heat insulating member 4 include resin materials, in particular, a composite material in which an inorganic filler such as silica particulates is added to polyphenyl sulfide (PPS) or polysulfone (PSF) as a base material.

Also in the present embodiment, in order to suppress damage to the joining portions where the heat insulating members 4 and the temperature equalizing members 3 are joined to one another, each of the heat insulating members 4 is provided for a corresponding one of the recording element substrates 2, thereby reducing the size of the heat insulating member 4. With the size-reduced heat insulating members 4, the absolute expansion amount of the heat insulating members 4 due to heat is reduced, and accordingly, the joining portions where the heat insulating members 4 and the temperature equalizing members 3 are joined to one another are not easily damaged.

In the case where the differences in linear expansion coefficient are sufficiently small, a single heat insulating member 4 can be provided for the plurality of recording element substrates 2 such that the single heat insulating member 4 extends over the plurality of recording element substrates 2.

Figure 3:
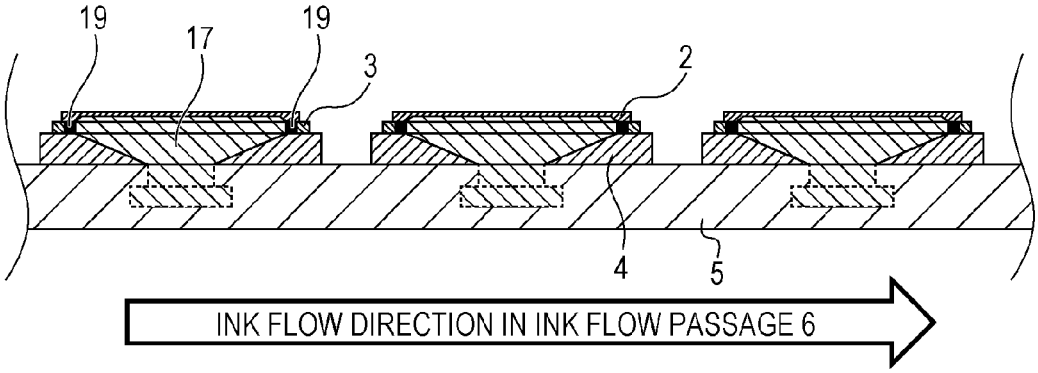
FIG. 3 is an enlarged sectional view of part of the liquid ejection head illustrated in FIG. 1 taken along line III-III in FIG. 1.
Figure 4:
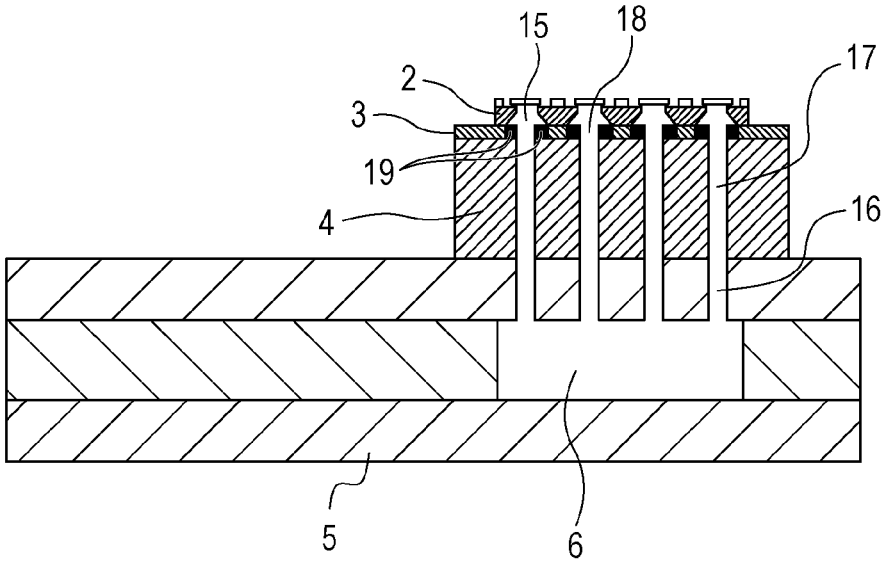
FIG. 4 is a sectional view of the liquid ejection head illustrated in FIG. 1 taken along line IV-IV in FIG. 1.
Figure 5:
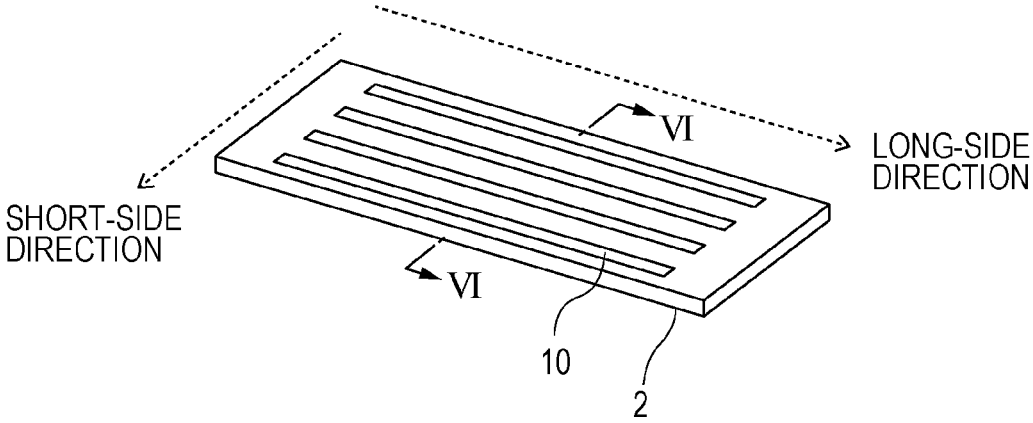
FIG. 5 is a perspective view schematically illustrating a recording element substrate.
Figure 6:
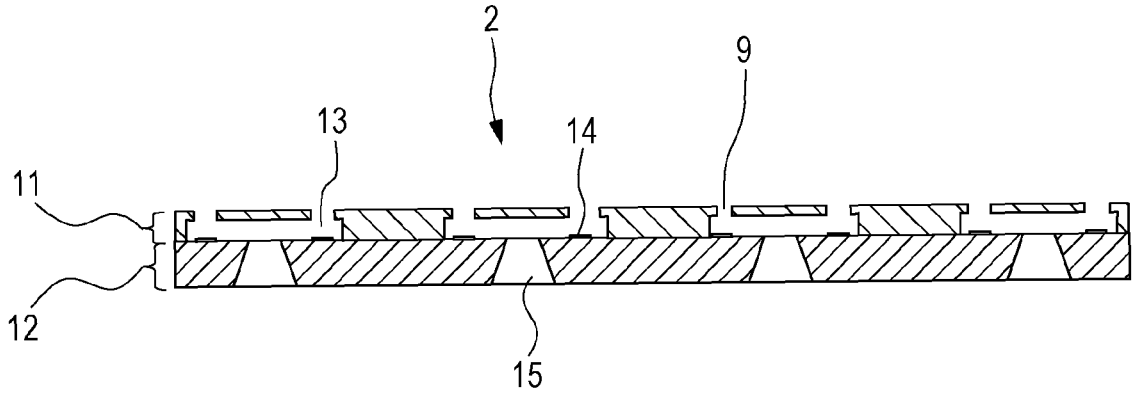
FIG. 6 is a sectional view of the recording element substrate illustrated in FIG. 5 taken along line VI-VI in FIG. 5.
Figure 7:
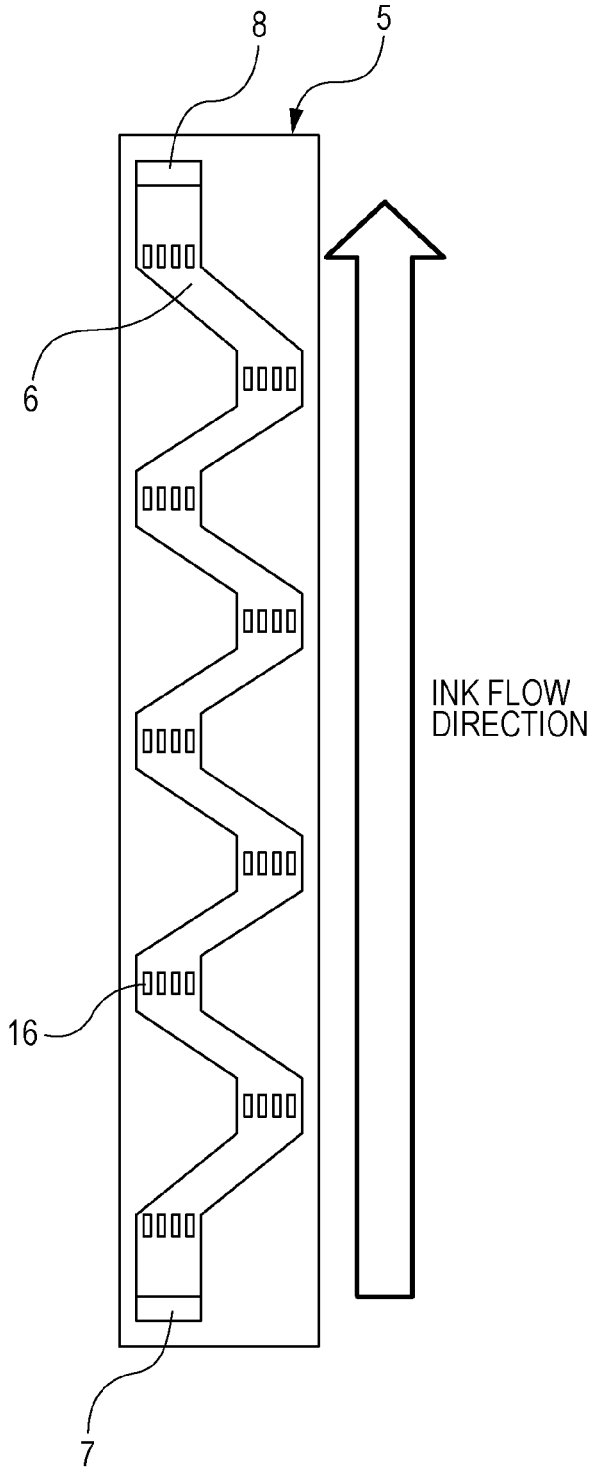
FIG. 7 is a schematic view of an internal structure of a base substrate.

FIG. 3 is an enlarged sectional view of part of the recording head 1 taken along line III-III in FIG. 1. FIG. 4 is a sectional view of the recording head 1 taken along line IV-IV in FIG. 1. FIG. 5 is a schematic view of the recording element substrate 2. FIG. 6 is a sectional view of the recording element substrate 2 taken along line VI-VI in FIG. 5. FIG. 7 is a schematic view of an internal structure of the base substrate 5.

As illustrated in FIG. 7, an ink flow passage 6 that extends in the long-side direction of the base substrate 5 is formed in the base substrate 5. An ink flow-in port 7 and an ink flow-out port 8 are respectively formed at both ends of the ink flow passage 6.

As illustrated in FIGS. 5 and 6, each recording element substrate 2 has four nozzle units 10, in each of which a plurality of nozzles 9 are arranged. Each nozzle unit 10 has two nozzle arrays. That is, eight nozzle arrays are formed in each recording element substrate 2.

Although the nozzle units 10 extend in the long-side direction of the base substrate 5 in the present embodiment, this does not limit the implementation of the nozzle units 10. For example, the nozzle units 10 may extend in the short-side direction of the base substrate 5. A direction in which the nozzle units 10 extend may also be referred to as a "nozzle array direction".

The recording element substrates 2 are members that eject ink using a thermal method.

Specifically, the recording element substrates 2 each include a nozzle layer (ejection port member) 11 and a heat board 12. The nozzle layer 11 is formed of a resin material. The heat board 12 is formed of a silicon (Si) material. Bubble generating chambers 13 and nozzles 9 are formed in the nozzle layer 11. The bubble generating chambers 13 form bubbles in ink. Ink droplets are ejected through the nozzles 9. In each heat board 12, separate heating elements 14 are disposed at positions corresponding to the bubble generating chambers 13. The heating elements 14 serve as energy generating elements that generate ejection energy.

The heating elements 14 are arranged along a straight line. The nozzles 9 are arranged in arrays so as to correspond to the respective heating elements 14. The heater board 12 has liquid supply ports 15 in a surface on a side opposite to the nozzle layer 11 side. Each of the liquid supply ports 15 communicates with the plurality of nozzles 9.

Electrical wiring (not shown) is provided inside the heater board 12. The electrical wiring is electrically connected to electrodes of a separate flexible printed circuit board (FPC) provided on the base substrate 5 (see FIG. 1) or to electrodes provided on the base substrate 5.

By inputting a pulse voltage from an external control circuit (not shown) to the heater board 12 through the electrodes, the heating elements 14 generate heat, thereby boiling the ink in the bubble generating chambers 13. Forces caused by bubble generation due to the boiling cause the ink to be ejected through the nozzles 9.

As illustrated in FIGS. 3 and 4, flow passages that extend from the ink flow passage 6 of the base substrate 5 to the liquid supply ports 15 of the recording element substrates 2 are formed in the temperature equalizing members 3 and the heat insulating members 4. These flow passages introduce the ink to the liquid supply ports 15.

Specifically, the heat insulating members 4 each have separate liquid chambers 17, which communicate with the ink flow passage 6 through liquid chamber communication ports 16 formed in the base substrate 5. The temperature equalizing members 3 each have slits 18 that penetrate through the temperature equalizing member 3 from a surface on the heat insulating member 4 side of the temperature equalizing member 3 to the surface on the recording element substrate 2 side of the temperature equalizing member 3. The slits 18 communicate with the separate liquid chambers 17 and the liquid supply ports 15. The separate liquid chambers 17 and the slits 18 form flow passages that extend from the ink flow passage 6 of the base substrate 5 to the liquid supply ports 15 of the recording element substrates 2.

The thermal conductivity, thickness, and the shape of the separate liquid chambers 17 in the heat insulating members 4 can be determined in accordance with the amount of heat transferred from the recording element substrates 2 to the ink in the base substrate 5.

For example, in the case where the number of the recording element substrates 2 that communicate with a single ink flow passage 6 is comparatively larger, more heat is transferred from the recording element substrates 2 to the ink in the base substrate 5, and accordingly, the temperature of the ink is increased. In order to reduce the amount of heat transferred from the recording element substrates 2 to the ink in the base substrate 5, the thickness of the heat insulating members 4 can be increased, the thermal conductivity of the heat insulating members 4 can be reduced, or a cavity can be formed in the heat insulating members 4.

With the heat insulating members 4, heat from each recording element substrates 2 is not easily transferred to the base substrate 5 and the ink in the base substrate 5, and is more easily transferred to the ink in the bubble generating chambers 13. Thus, even in the case where the amount of heat generated by the recording element substrates 2 is increased when high-speed printing is performed, the amount of heat transferred to the ink that flows in the ink flow passage 6 of the base substrate 5 is suppressed. This allows the heat exchange capacity of a cooling device that cools the ink to be reduced.

The base substrate 5 can be formed of a material having a low thermal expansion coefficient. Also, the base substrate 5 needs to have a stiffness so that the recording head 1 is not bent and a sufficient corrosion resistance against ink. For example, the base substrate 5 can be formed of alumina.

The base substrate 5 can be formed of a single plate-shaped member or formed by stacking a plurality of plate-shaped members one on top of another. When the base substrate 5 is formed by stacking a plurality of plate-shaped members, the ink flow passage 6 can be formed when the plate-shaped members are stacked. Since this can facilitate the formation of the ink flow passage 6, the base substrate 5 is more desirably formed by stacking a plurality of plate-shaped members.

Heat insulation layers 19 are provided on inner side surfaces of the slits 18, that is, on wall surfaces of the flow passages that penetrate through the temperature equalizing members 3. With the heat insulation layers 19, the temperature equalizing members 3 are thermally insulated from the ink that flows through the slits 18.

When heat from one of the temperature equalizing members 3 is not easily transferred to the ink that flows through the slits 18 of this heat equalizing member 3, heat from a portion of the recording element substrate 2 is easily transferred to other portions of the recording element substrate 2 through the temperature equalizing member 3. This suppresses non-uniformity of the temperature distribution over the recording element substrate 2.

The effect produced by the heat insulation layers 19 will be more specifically described along with a phenomenon occurring in the recording element substrates 2 when a belt-shaped image is printed.

When a belt-shaped image is printed, out of the plurality of heating elements 14 (see FIG. 6), only the heating elements 14 disposed at portions of the recording element substrate 2 with respect to the nozzle array direction are continuously operated, thereby increasing the temperature at the portions of the recording element substrate 2. As a result, in the recording element substrate 2, the temperature of continuous operation portions, in which the heating elements 14 are continuously operated, becomes higher than that of non-continuous operation portions, in which the heating elements 14 are not continuously operated.

Each temperature equalizing member 3 produces a temperature equalizing effect when the temperature varies over the corresponding recording element substrate 2. However, in a structure in which the heat insulation layers 19 are not provided on the inner side surfaces of the slits 18 of the temperature equalizing member 3, the temperature equalizing member 3 is brought into contact with the ink, and accordingly, heat is transferred from the temperature equalizing member 3 to the ink. As a result, transference of heat to the non-continuous operation portions is insufficient, and accordingly, non-uniformity of the temperature distribution over the recording element substrate 2 cannot be sufficiently suppressed.

In contrast, when the heat insulation layers 19 are provided on the inner side surfaces of the slits 18 of the temperature equalizing member 3, heat is not easily transferred from the temperature equalizing member 3 to the ink in the slits 18. As a result, in the recording element substrate 2, heat of the continuous operation portions is easily transferred to the non-continuous operation portions through the temperature equalizing member 3, and accordingly, non-uniformity of the temperature distribution over the recording element substrate 2 can be sufficiently suppressed.

The temperature equalizing members 3 do not necessarily have a plate-shape. For example, the temperature equalizing members 3 may have a heat pipe that extends in a direction in which the nozzles 9 are arranged. The heat transfer capacity of the heat pipe is higher than that of a plate-shaped member. For example, the heat pipe has a heat transfer capacity equal to about a hundred times the thermal conductivity of a plate-shaped member formed of Cu.

When the temperature equalizing member 3 uses a member having a heat pipe, non-uniformity of the temperature distribution over the recording element substrate 2 can be significantly reduced. In this case, when the ends of the heat pipe are open, the heat pipes can be more effective because the temperature difference between a heat receiving portion and a heat dissipating portion in the heat pipe can be maintained.

Figure 8A:
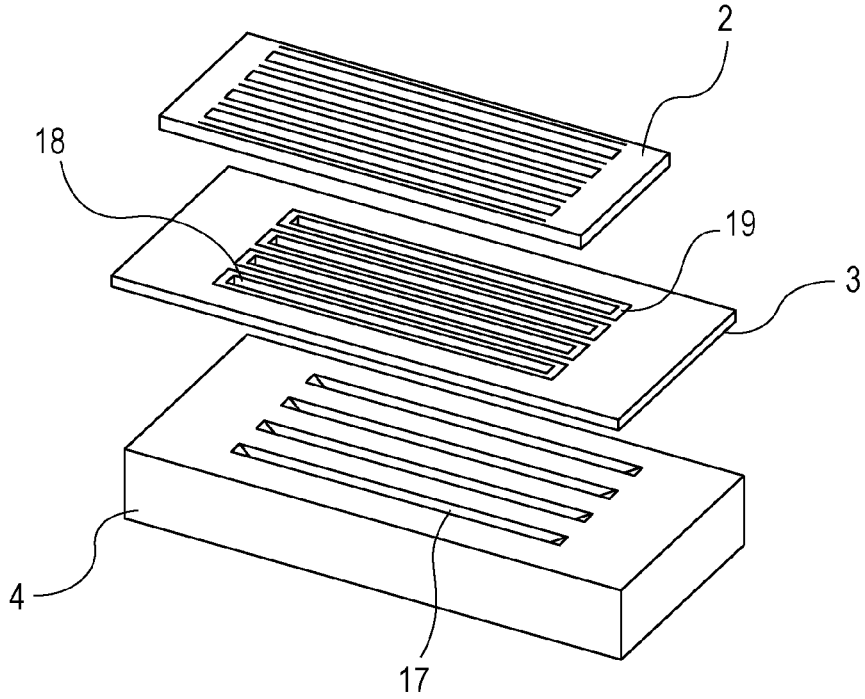
FIGS. 8A and 8B are exploded perspective views schematically illustrating the recording element substrate, a temperature equalizing member, and a heat insulating member.
Figure 8B:
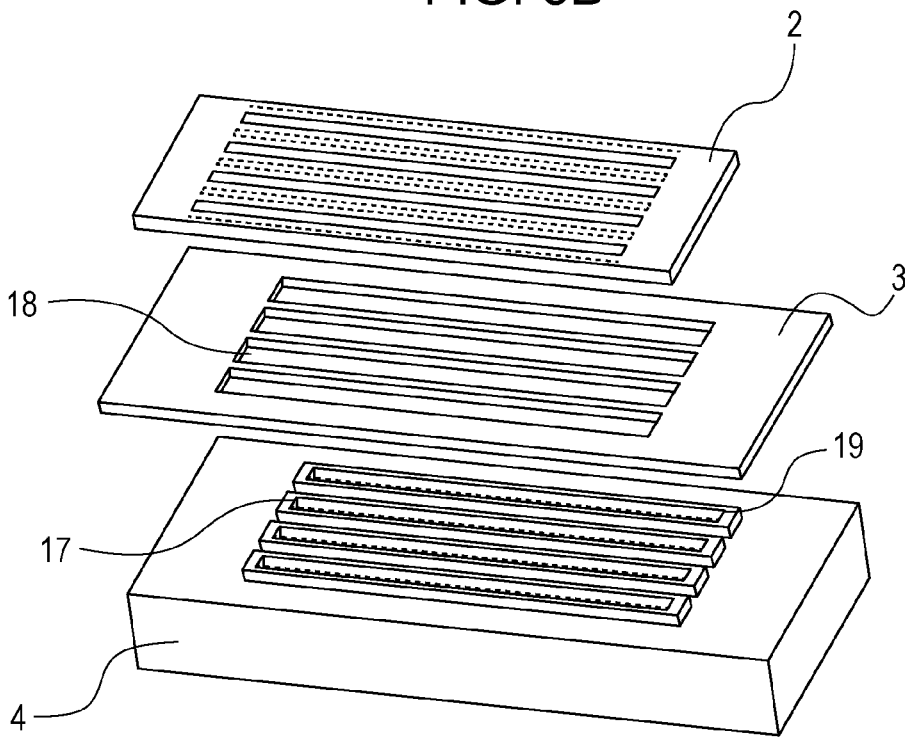

FIG. 8A is a schematic view of examples of the recording element substrate 2, the temperature equalizing member 3, and the heat insulating member 4 before they are joined to one another. FIG. 8B is a schematic view of other examples of the recording element substrate 2, the temperature equalizing member 3, and the heat insulating member 4 before they are joined to one another.

In the examples illustrated in FIG. 8A, the heat insulation layers 19 are bonded in advance to the inner side surfaces of the slits 18 of the temperature equalizing member 3. In the examples illustrated in FIG. 8B, the heat insulation layers 19 are integrally formed with the heat insulating member 4, and by joining the heat insulating member 4 and the temperature equalizing member 3 to each other, the heat insulation layers 19 are engaged with the slits 18 of the temperature equalizing member 3. Although either structure can be effective, from a viewpoint of reduction in the number of components and reduction in the cost, the heat insulation layers 19 are more desirably integrally formed with the heat insulating member 4 (structure illustrated in FIG. 8B).

Description in Recording Drive Operation

Figure 9:
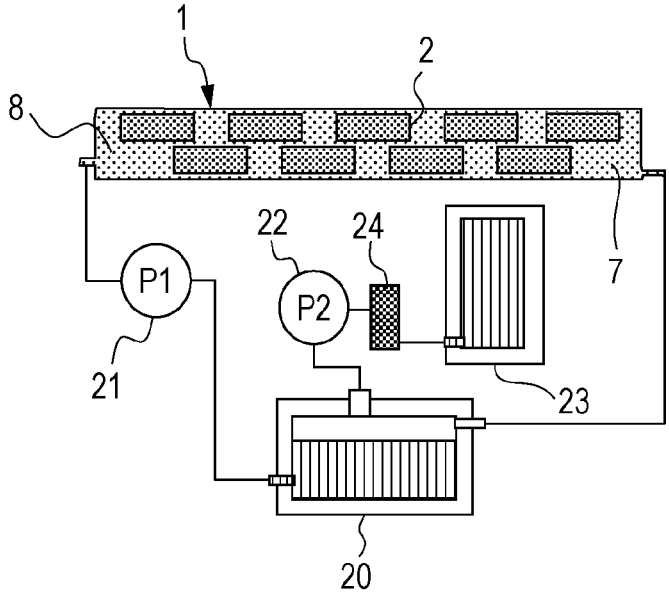
FIG. 9 is a connection diagram of the liquid ejection head, ink tubes, pumps, and an ink tank.

Next, operation of the recording head 1 is described. FIG. 9 is a schematic view illustrating a state in which the recording head 1 is connected to pumps, an ink tank, and the like.

The ink flow-in port 7 of the recording head 1 is connected to a temperature adjustment tank 20 through a resin tube. The ink flow-out port 8 of the recording head 1 is connected to a circulation pump 21 through a resin tube.

The circulation pump 21 is connected to the temperature adjustment tank 20, thereby allowing the ink to be circulated between the temperature adjustment tank 20 and the recording head 1. The temperature adjustment tank 20 is connected to a heat exchanger (not shown) such that heat can be exchanged between the temperature adjustment tank 20 and the heat exchanger so as to maintain at a certain level the temperature of the ink that flows back through the circulation pump 21. Furthermore, the temperature adjustment tank 20 has a communication hole (not shown) that opens toward the outside thereof, thereby exhausting bubbles in the ink to the outside thereof.

The temperature adjustment tank 20 is also connected to a supply pump 22. The supply pump 22 moves the ink from an ink tank 23 to the temperature adjustment tank 20 by the same amount as the amount ejected from the recording head 1 through printing. A filter 24 is provided between the ink tank 23 and the supply pump 22. The filter 24 removes foreign matter from the ink.

An FPC (not shown) is provided in the recording head 1. Signal input terminals of the recording element substrates 2 are electrically connected to the FPC. The ink is ejected through the nozzles 9 (see FIG. 6) when an ejection signal is transmitted in accordance with image data from the external control circuit (not shown) to the heating elements 14 (see FIG. 6) of the recording element substrates 2 through the FPC.

When the recording head 1 is operated, the circulation pump 21 causes the ink to circulate between the recording head 1 and the temperature adjustment tank 20. As a result, the temperature of the ink supplied to the recording head 1 is maintained at a certain level.

As illustrated in FIGS. 1 to 4, the recording head 1 includes the heat insulating members 4. Thus, heat from the recording element substrates 2 is not easily transferred to the base substrate 5 and the ink in the ink flow passage 6, and accordingly, most of the heat generated in the recording element substrates 2 is transferred to the ink in the bubble generating chambers 13. The temperature difference among portions of the ink in the ink flow passage 6 is comparative small, and the temperature difference among portions of the ink supplied to the different recording element substrates 2 is also small.

When the amount of heat generated in the recording element substrates 2 changes in accordance with the duty cycle, the ejection amount is also changed. In the recording head 1, the temperature of the ink to be ejected is controlled so as to be maintained substantially constant despite the difference in duty cycle when printing an image that is uniform over a sheet of recording paper (also referred to as a "solid image"). Also in the recording head 1, even when there is the difference in duty cycle among the recording element substrates 2, the difference between the temperatures of the ink ejected from different recording element substrates 2 is comparatively small because of a self-balancing effect.

When printing, for example, a belt-shaped image, part of the recording element substrate 2 is continuously operated. In this case, the temperature difference occurs in the recording element substrate 2 between the continuous operation portions and the non-continuous operation portions. This temperature difference becomes maximum when about a half of the recording element substrate 2 is continuously operated at the maximum duty cycle and the remaining half of the recording element substrate 2 is not operated.

Figure 10:
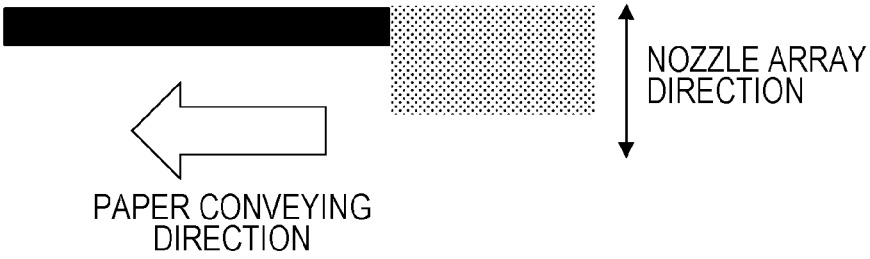
FIG. 10 is an example of a recorded image having a belt-shaped image portion and a solid image portion.

When a solid image is printed in a state in which the temperature difference between the continuous operation portions and the non-continuous operation portions exists in the recording element substrate 2, the temperature difference between the continuous operation portions and the non-continuous operation portions may cause uneven print density in the recorded image. Referring to FIG. 10, an image in which such uneven print density tends to occur is specifically described.

FIG. 10 is an example of a recorded image having a belt-shaped image portion and a solid image portion. A region filled in with black represents the belt-shaped image portion and a dotted region represents the solid image portion.

As illustrated in FIG. 10, when the belt-shaped image portion is being printed, part of the recording element substrate 2 is continuously operated. When the capacity of the temperature equalizing member 3 to equalize the temperature of the recording element substrate 2 is not sufficient, the temperature is increased in the continuous operation portions of the recording element substrate 2 and the temperature is not increased in the non-continuous operation portions of the recording element substrate 2.

When printing of the solid image portion is started in a state in which the temperature difference between the continuous operation portions and the non-continuous operation portions exists, uneven print density is caused by the difference in ink ejection amount.

Since the recording head 1 according to the present embodiment includes the temperature equalizing members 3 and the heat insulation layers 19, when the belt-shaped image portion is printed, non-uniformity of the temperature distribution over the recording element substrate 2, that is, the temperature difference between the continuous operation portions and the non-continuous operation portions can be reduced. As a result, uneven print density of the solid image portion can be decreased.

Next, the temperature distribution over the recording element substrate 2 occurring when the ink is ejected with the recording head 1 is described. The temperature distribution over the recording element substrate 2 is examined through a numerical analysis.

More specifically, the temperature distribution over the recording element substrate 2 is calculated by a numerical analysis in the case where the image illustrated in FIG. 10 is printed by using the recording element substrate 2 of one of examples or one of comparative examples with the recording head 1 illustrated in FIG. 1 connected to the temperature adjustment tank 20, the circulation pump 21 (see FIG. 9), and the like. The duty cycles for the belt-shaped image portion and the solid image portion are respectively set to 100% and 25%. The conditions such as printing speed and image resolution are set as described in Table 1.

TABLE 1

| | |
|---|---|
| Image size | L-size |
| Printing speed (ppm): longitudinal feed | 100 |
| Image resolution (dpi) | 1200 |
| Drop volume (pL) | 2.8 |
| Ejection energy (μJ/bit) | 0.5 |
| Ink circulation rate (mL/min) | 25 |
| Ink supply temperature (° C.) | 27 |
| Ink specific gravity | 1.08 |

First Example

As a first example, a numerical analysis is performed on the recording head 1, which is assumed to include the temperature equalizing members 3 formed of an Si plate-shaped members (thermal conductivity: 140 W/m/K), the base substrate 5 formed of alumina, and heat insulating members 4 formed of PPS. In the numerical analysis, it is also assumed that a thermal resistance equal to that of a resin adhesive of 5 μm thickness exists between each recording element substrate 2 and a corresponding one of the temperature equalizing member 3.

Figure 11:
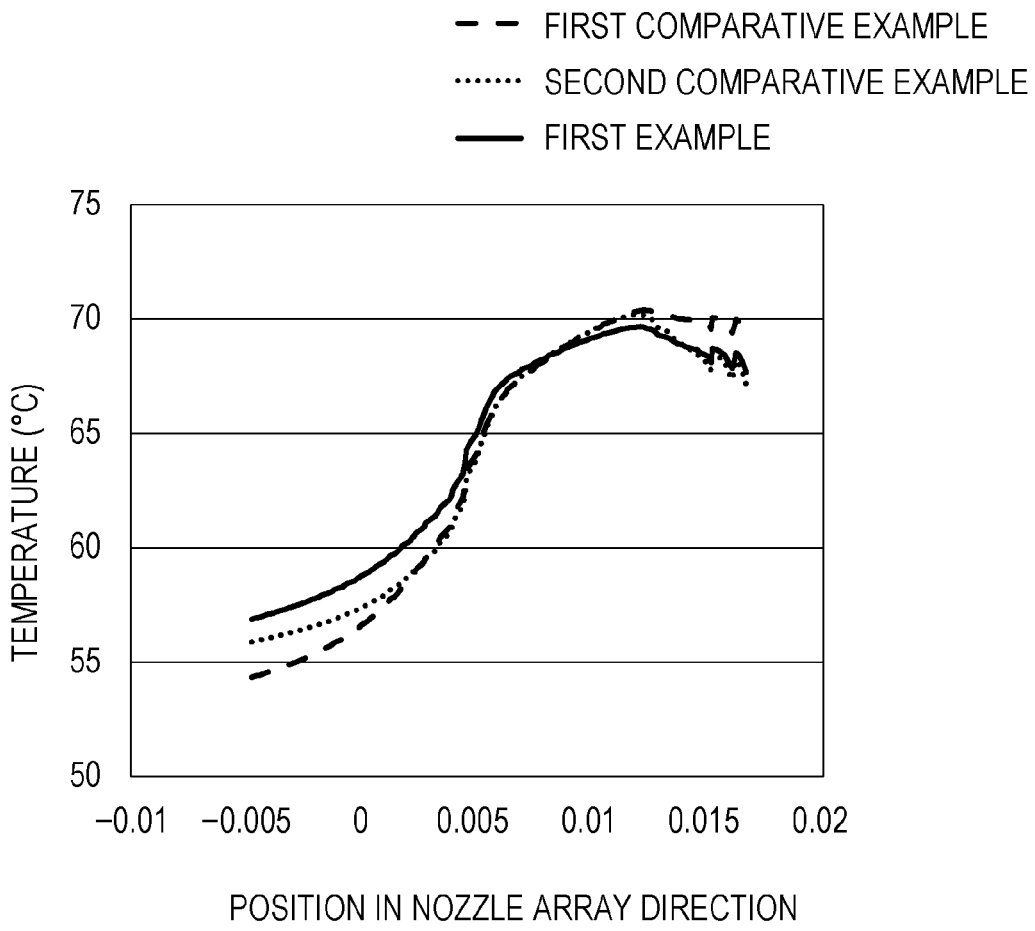
FIG. 11 is a graph illustrating temperature distributions in a nozzle array direction over the recording element substrates according to a first example, a first comparative example, and a second comparative example.

FIG. 11 illustrates temperature distributions in the nozzle array direction in one of the recording element substrates 2, which is, out of the plurality of recording element substrates 2, positioned on the most upstream side with respect to the ink flow direction in the ink flow passage 6 (see FIG. 7). Here, for obtaining the temperature distribution in the nozzle array direction of the recording element substrate 2, temperatures in four nozzle units 10 arranged in the nozzle array direction of the recording element substrate 2 illustrated in FIG. 5 are averaged. The positive direction of the horizontal axis of the graph illustrated in FIG. 11 represents the ink flow direction in the ink flow passage 6.

First and Second Comparative Examples

As a first comparative example, the numerical analysis is performed on the assumption that a recording head does not include the temperature equalizing members 3. The dimensions and shapes of the components such as the recording element substrates, the heat insulating members, and the base substrate, the printing conditions, and the like are the same as those of the first example. The temperature distribution over the recording element substrate of the first comparative example is indicated by a chain line in FIG. 11.

As a second comparative example, the numerical analysis is performed on the assumption that a recording head includes the temperature equalizing members 3, which do not have the heat insulation layers 19 on the inner side surfaces of the slits 18. The dimensions and shapes of the components such as the recording element substrates, the heat insulating members, and the base substrate, the printing conditions, and the like are the same as those of the first example. The temperature distribution over the recording element substrate of the second comparative example is indicated by a dotted line in FIG. 11.

Comparison Among First Example, First Comparative Example, and Second Comparative Example As can be seen from FIG. 11, the difference between the maximum and minimum temperatures in the recording element substrate (hereafter, simply referred to as "temperature difference t") is 16.4° C. in the recording head according to the first comparative example, and 14.4° C. in the recording head according to the second comparative example. That is, the temperature difference t is decreased by about 12% by the temperature equalizing member 3.

The temperature difference t in the recording element substrate 2 according to the first example is 12.8° C., that is, decreased by 22% compared to that of the first comparative example. This is the effect produced by the temperature equalizing member 3 and the heat insulation layers 19 provided on the inner side surfaces of the slits 18 of the temperature equalizing member 3. Thus, non-uniformity of the temperature distribution over the recording element substrate 2 is further reduced.

Second Example

As a second example, a numerical analysis is performed on the assumption that the recording head 1 includes the recording element substrates 2, which are integrated with the respective temperature equalizing members 3 by Si—Si bond. That is, in the present example, the thermal resistant existing between each recording element substrate 2 and a corresponding one of the temperature equalizing members 3 is zero. Structures are the same as those of the first example except for elimination of the thermal resistance equal to that of the resin adhesive in the first example is eliminated.

The temperature difference t in the recording element substrate 2 of the recording head 1 according to the present example is 12.4° C., that is, decreased by 24% compared to that of the first comparative example.

Third Example

Figure 12:
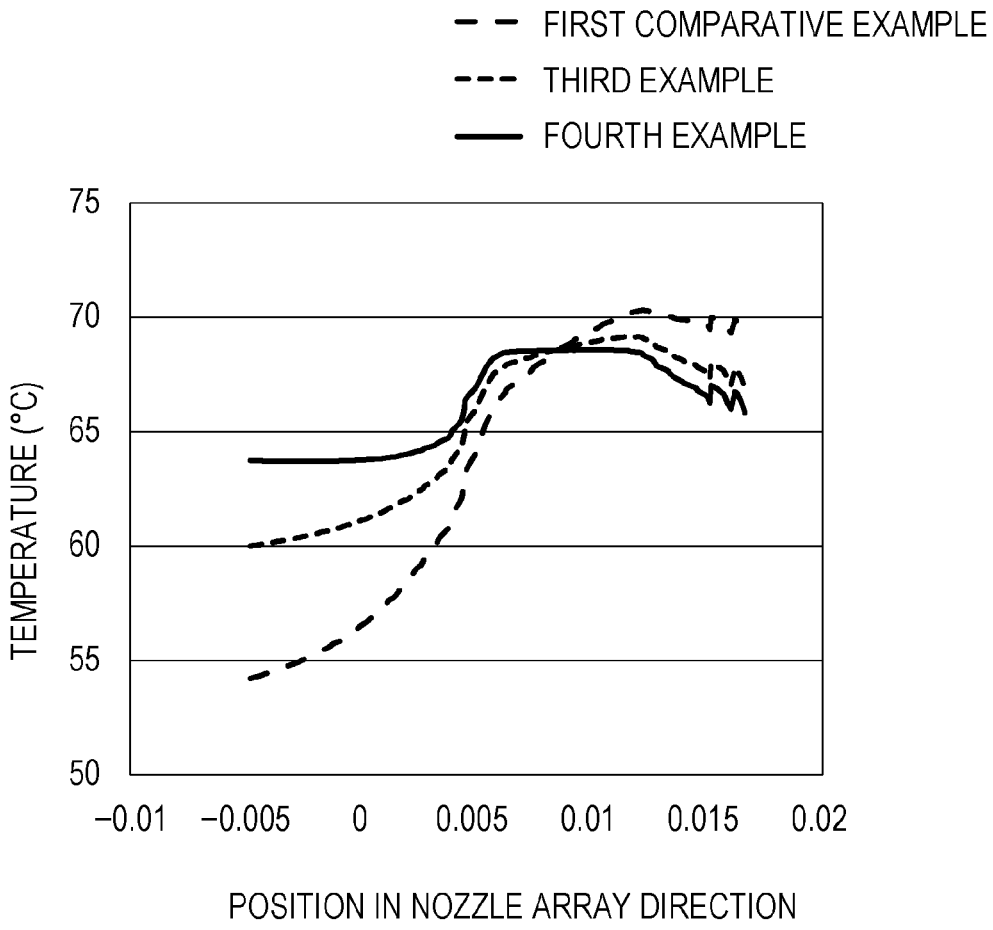
FIG. 12 is a graph illustrating temperature distributions in the nozzle array direction over the recording element substrates according to a third example, a fourth example, and the first comparative example.

As a third example, a numerical analysis is performed on the assumption that the temperature equalizing members 3 of the recording head 1 are formed of single crystal SiC plate-shaped members (thermal conductivity: 140 W/m/K). Structures other than the material of the temperature equalizing members 3 are the same as those of the recording head of the first example. The temperature distribution over the recording element substrate 2 according to the third example is illustrated in FIG. 12 along with the result of the first comparative example. The temperature difference t in the recording element substrate 2 of the recording head 1 according to the third example is 9.1° C., that is, decreased by 44% compared to that of the first comparative example.

Fourth Example

In a fourth example, the temperature equalizing members 3 of the recording head 1 use heat pipes. Structures according to the fourth embodiment other than the structure of the temperature equalizing members 3 are the same as those of the recording head of the first example. The temperature distribution over the recording element substrate 2 of the fourth example is indicated by a solid line in FIG. 12. The temperature difference t in the recording element substrate 2 according to the fourth example is 4.9° C., that is, decreased by 70% compared to that of the first comparative example.

Comparison Among First to Fourth Examples and First and Second Comparative Examples The temperature differences t in the recording element substrates 2 among the first to fourth examples and the first and second comparative examples are summarized in Table 2. As can be seen from Table 2, with the recording heads 1 according to the first to fourth examples, non-uniformity of the temperature distribution over the recording element substrate 2 can be reduced even when printing the belt-shaped image portion. Thus, with the recording head 1, uneven print density in the solid image portion does not easily occur even in the case where the solid image portion is printed after the belt-shaped image portion has been printed, and accordingly, the quality of a recorded image is improved.

TABLE 2

| | Comparative example | | Example | | | |
|---|---|---|---|---|---|---|
| | First | Second | First | Second | Third | Fourth |
| Temperature difference t (° C.) | 16.4 | 14.3 | 12.8 | 12.4 | 9.1 | 4.9 |
| Temperature difference reduction ratio (%) | — | 12 | 22 | 24 | 44 | 70 |

While the present invention has been described with reference to exemplary embodiment, it is to be understood that the invention is not limited to the disclosed exemplary embodiment. The scope of the following claims is to be accorded the broadest interpretation so as to encompass all such modifications and equivalent structures and functions.

This application claims the benefit of Japanese Patent Application No. 2012-164686, filed Jul. 25, 2012, which is hereby incorporated by reference herein in its entirety.

What is claimed is:

1. A liquid ejection head comprising:

a plurality of recording element substrates that each include an energy generating element that generates energy utilized for ejecting a liquid, the plurality of recording element substrates each having a supply port through which the liquid is supplied to the energy generating element;

a plurality of support members that each have a flow passage that communicates with a corresponding one of the supply ports, the support members each supporting a corresponding one of the plurality of recording element substrates, wherein heat insulation layers are provided on inner side surfaces of each flow passage;

a base substrate that supports the plurality of support members; and a plurality of heat insulating members disposed between the flow passages and the base substrate, wherein an individual heat insulating member corresponds to a recording element substrate, wherein a thermal conductivity of the support members is equal to or greater than a thermal conductivity of the recording element substrates, and wherein a thermal conductivity of the heat insulating member is less than a thermal conductivity of the base substrate.

2. The liquid ejection head according to claim 1, wherein the thermal conductivity of the heat insulating member is less than the thermal conductivity of the support members.

3. The liquid ejection head according to claim 1, wherein the support members each include a heat pipe that extends in a direction in which the plurality of recording element substrates are arranged.

4. The liquid ejection head according to claim 1, wherein the recording element substrates each include a board that supports the energy generating element, the supply port being formed in the board, and an ejection port member that has an ejection port through which the liquid is ejected.

5. The liquid ejection head according to claim 4, wherein the thermal conductivity of the support members is equal to or greater than a thermal conductivity of the boards.

6. A liquid ejection head comprising:

a first recording element substrate and a second recording element substrate that each include an energy generating element that generates energy utilized for ejecting a liquid, the first and second recording element substrates each having a supply port through which the liquid is supplied to the energy generating element;

a first support member having a flow passage that communicates with a corresponding one of the supply ports, the first support member supporting the first recording element substrate;

a second support member having a flow passage that communicates with a corresponding one of the supply ports, the second support member supporting the second recording element substrate, wherein heat insulation layers are provided on inner side surfaces of each flow passage of the first and second support member;

a base substrate that supports the first and second support members; and a plurality of heat insulating members disposed between the flow passages of the first and second support members and the base substrate, wherein an individual heat insulating member corresponds to a recording element substrate, wherein a thermal conductivity of the first support member is equal to or greater than a thermal conductivity of the first recording element substrate, and a thermal conductivity of the second support member is equal to or greater than a thermal conductivity of the second recording element substrate, and wherein, a thermal conductivity of the heat insulating member is less than a thermal conductivity of the base substrate.

7. The liquid ejection head according to claim 6, wherein the first and second recording element substrates respectively include a first board and a second board that each support the energy generating element, the supply port being formed in each of the first and second boards, and first and second ejection port members that each have an ejection port through which the liquid is ejected.

8. The liquid ejection head according to claim 7, wherein the thermal conductivity of the first support member and the thermal conductivity of the second support member are respectively equal to or greater than a thermal conductivity of the first board and a thermal conductivity of the second board.

9. The liquid ejection head according to claim 6, wherein the thermal conductivity of the heat insulating member is less than the thermal conductivity of the first support member and the thermal conductivity of the second support member.

10. The liquid ejection head according to claim 6, wherein the first and second support members each include a heat pipe that extends in a direction in which the first and second recording element substrates are arranged.

* * * * *